United States Patent [19]

Lee

[11] Patent Number: 4,571,827

[45] Date of Patent: Feb. 25, 1986

[54] VIBRISSA CUTTERS

[76] Inventor: Chin-Piao Lee, No. 9 Lane 450, Feng Rd., Tainan, Taiwan

[21] Appl. No.: 661,715

[22] Filed: Oct. 17, 1984

[51] Int. Cl.[4] ..... B26B 19/16

[52] U.S. Cl. ..... 30/29.5

[58] Field of Search ..... 30/29.5, 240

[56] References Cited

U.S. PATENT DOCUMENTS

| | | | |
|---|---|---|---|
| 1,973,631 | 9/1934 | Johnson | 30/29.5 |
| 2,074,020 | 3/1937 | Marholt | 30/29.5 |
| 2,111,861 | 3/1938 | Knapp | 30/29.5 |
| 2,191,073 | 2/1940 | Fishbein | 30/29.5 |
| 2,235,326 | 3/1941 | Muros | 30/29.5 |
| 2,262,315 | 11/1941 | Davies | 30/29.5 |
| 2,312,933 | 3/1943 | Seiders | 30/29.5 |
| 2,764,811 | 10/1956 | Guardino | 30/29.5 |

FOREIGN PATENT DOCUMENTS

| | | | |
|---|---|---|---|
| 951760 | 10/1956 | Fed. Rep. of Germany | 30/29.5 |

*Primary Examiner*—Jimmy C. Peters

*Attorney, Agent, or Firm*—Holman & Stern

[57] ABSTRACT

This invention concerns about an improvement in a vibrissa cutter. This cutter is preferrably referred to such one that comprises exterior blades mounted on an exterior shell, interior blades mounted on an interior blade rod and an interior blade turning cylinder equipped with a stopping pin on its top. A notch with a proper width is cut out around the bottom wall of said exterior shell. Said interior blade rod is combined together with said interior blade turning cylinder by means of a screw put through side of said turning cylinder and then the upper part of said interior rod is inserted in the inside of said exterior shell, and the stopping pin is to be placed in said notch. Said interior blade will turn to and fro at the same speed as the turning cylinder is turned to and fro by user's fingers to cut off those vibrissae that come into the openings of exterior and interior blades and said stopping pin is allowed to move only within the limited distance of said notch's width. When said stopping pin is moved to either of the two ends of said notch, each interior blade is rightly in line with each exterior blade, i.e. each opening between said interior blades is also rightly in line with that between said exterior blades. Therefore, the vibrissae can be inserted into the openings between blades freely and be cut off without feeling any pain caused by vibrissae being pulled by the blades.

1 Claim, 7 Drawing Figures

VIBRISSA CUTTERS

BACKGROUND OF THE INVENTION

The conventional vibrissa cutter generally comprises an exterior shell with several exterior blades—maybe eight to twelve pieces of blades—an interior rod with several interior blades (the same number as the exterior blades), and a turning cylinder placed under the interior rod. The most upper part of said interior rod is inserted into said exterior shell so that said interior blades can get close to the exterior blades. Since the turning cylinder is to be turned for 360°, there is no definite probability that both the exterior and interior blades completely overlap one another and besides, vibrissae are easily caught between the exterior and interior blades and pulled with pain. Furthermore, owing to the difficulty for both blades to get complete and tight overlap its cutting efficiency is quite low so that it forms a defect of the conventional cutter.

In view to the above-mentioned defect, the inventor has worked out this improvement in this invention, to make the turning cylinder turn to and fro in a notch with a limited width.

In this new cutter, the exterior blades and the interior ones can be made to overlap completely, no matter whether the turning cylinder stays at either of the two limited ends of the notch. Therefore, vibrissae always go in the openings between blades when the cutter is inserted into or pulled out of the nostril without fear that vibrissae would be pulled by the blades. It is really a well-designed improvement in a vibrissa cutter.

DETAILED DESCRIPTION OF THE INVENTION

Figure 1:
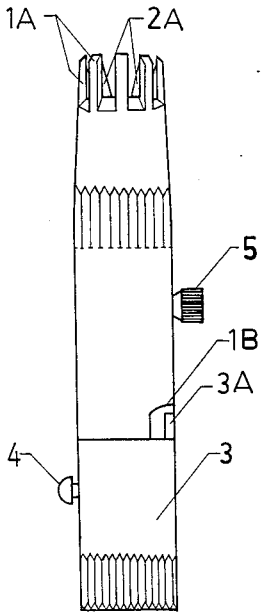
FIG. 1 is the front view of this cutter in this invention.
Figure 3:
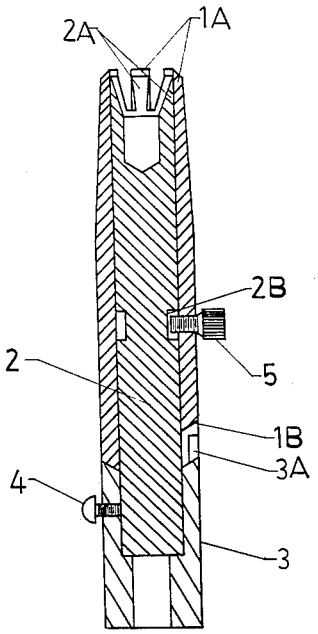
FIG. 3 is the cross-section view of this cutter in this invention.
Figure 6:
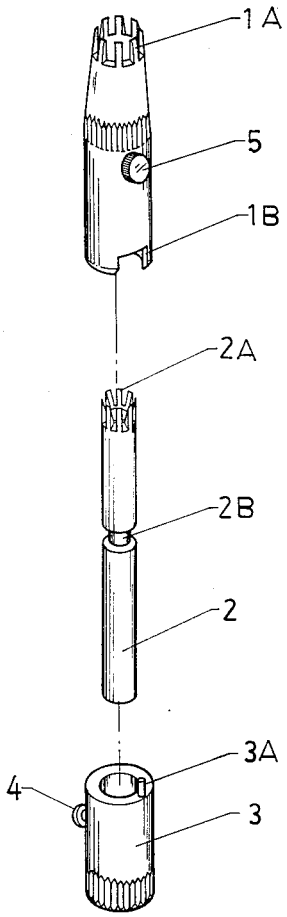
FIG. 6 is the view of the parts of this cutter separated in this invention.

As shown in FIG. 6, this invention, a vibrissa cutter comprises cylindrical exterior shell 1 with a number of exterior blades 1A mounted on its top, interior blade rod 2 with a number of interior blades 2A mounted on its top and interior blade turning cylinder 3. All the three parts are made of steel, having little capacity and little weight. Said interior blade rod 2 is to be coupled together with turning cylinder 3, with its lower part inserted in said cylinder 3 and fixed by screwing screw 4 through the side of said cylinder 3; said exterior shell 1 is coupled with the upper part of said interior blade rod 2. Those three parts combined together as a unit are shown in FIGS. 1, 3 & 7.

After guiding button 5 is screwed into the side of said exterior shell 1 and inserted in ring ditch 2B, said combined body of 2 & 3 is pivotally combined together with said exterior shell 1; if said turning cylinder 3 is turned right or left by user's fingers, said interior blade rod 2 is also turned accordingly inside said exterior shell 1.

Figure 7:
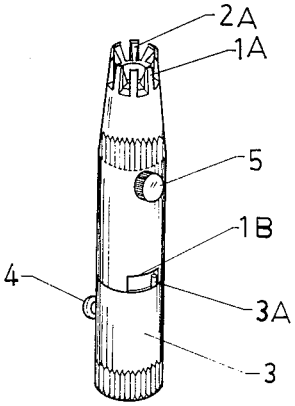
FIG. 7 is a general view of this cutter in this invention.

Now FIG. 7 is to be referred. After said combined body of said interior blade rod 2 and said turning cylinder 3 has been combined with said exterior shell 1, with stopping pin 3A on the top of said turning cylinder 3 placed into notch 1B at the bottom of said exterior shell 1, said turning cylinder 3 can turn freely only within the limited distance of said notch 1B. Of course, actuated by the turning of said turning cylinder 3, said interior blade rod 2 simultaneously leads those interior blades 2A to turn to and fro touching tightly with those exterior blades 1A to carry out the action of cutting through touching of the sharp edges of both blades.

Figure 2:
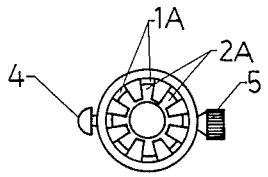
FIG. 2 is the top view of this cutter in this invention.
Figure 4:
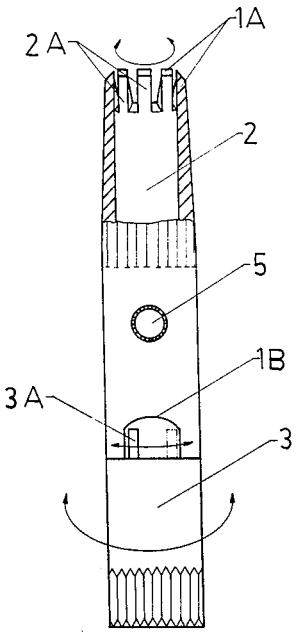
FIG. 4 is the operating illustration of this cutter in this invention.

FIG. 2 is the top view of this cutter. FIG. 4 shows that interior blades 2A on the top of the interior blade rod 2 turn to and fro at the same speed as said turning cylinder 3 is turned to and fro by fingers' twisting for cutting.

Figure 5:
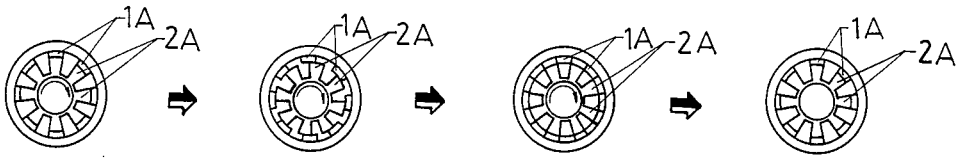
FIG. 5 is the process view of how the exterior and interior blades work.

The limited distance of said notch 1B allows said turning cylinder 3 to turn to and fro only about 60°. This cutter has 8 exterior blades 1A and 8 interior blades 2A which always come to a complete lap—blade to blade, opening to opening—when said turning cylinder 3 turns to and stays at one of the both limited ends of said notch 1B. In FIG. 5, from left to right, it shows the gradual transition of said interior blades 2A in relation to said exterior blades 1A as said turning cylinder 3 is being moved from one limited end to the other one of said notch 1B. The most leftward one shows that said exterior blades 1A lap said interior blades 2A when said turning cylinder 3 remains at one limited end. As this figure shows, vibrissae can extend through the openings between blades and be ready for cutting should this cutter be inserted into a nostril. The second figure from left shows the action of cutting while said turning cylinder 3 is being turned; the third figure from left shows that said turning cylinder 3 is turned to the middle of its path to finish cutting action. Lastly, the most rightward one shows that said exterior blades 1A and said interior blades 2A once again completely lap each other in the same way as shown in the most leftward figure. Therefore, as long as said turning cylinder 3 is turned to any of the two limited ends of its path, this cutter can be inserted in or pulled out of a nostril without feeling any pain caused by vibrissae being caught between the exterior and interior blades and pulled. So there is no doubt that this cutter is really safe, practical and easy for operating.

What is claimed is:

1. A sort of vibrissa cutter comprising an exterior cylindrical shell mounted with a number of exterior blades on its top, an interior blades rod mounted with the same number of interior blades on its top as the exterior ones and a turning cylinder combined with said interior blade rod by a screw, which is characterized by said exterior shell cut around its bottom wall with a notch in which a stopping pin on the top of said turning cylinder is to stop the turning of said interior blades when said exterior shell is combined together with the combined body of said interior blade rod and said turning cylinder and said turning cylinder able to turn only within the limited distance of said notch's width and said exterior blades lapping completely with said interior blades whenever said stopping pin of the said turning cylinder stays at either of the limited ends of said notch and the openings between blades in both exterior and interior blades completely coincide with one another so that vibrissae can go into these openings between blades for cutting and will not be pulled while cutting.

* * * * *